US005320900A

United States Patent [19]

Oathout

[11] Patent Number: 5,320,900

[45] Date of Patent: Jun. 14, 1994

[54] HIGH ABSORBENCY CLEANROOM WIPES HAVING LOW PARTICLES

[75] Inventor: James M. Oathout, Mt. Juliet, Tenn.

[73] Assignee: E. I. du Pont de Nemours and Company, Wilmington, Del.

[21] Appl. No.: 105,087

[22] Filed: Aug. 10, 1993

[51] Int. Cl.[5] ..... A47L 13/16; D04H 1/42; D04H 1/46

[52] U.S. Cl. ..... 428/288; 15/210.1; 28/104; 428/297

[58] Field of Search ..... 15/210.1; 28/104; 428/288, 297

[56] References Cited

U.S. PATENT DOCUMENTS

| | | | |
|---|---|---|---|
| 3,403,862 | 10/1968 | Dworjanyn . | |
| 3,485,706 | 12/1969 | Evans . | |
| 3,485,709 | 12/1969 | Evans et al. . | |
| 3,493,462 | 2/1970 | Bunting et al. . | |
| 3,508,308 | 4/1970 | Bunting et al. . | |
| 3,560,326 | 2/1971 | Bunting et al. . | |
| 3,620,903 | 11/1971 | Bunting et al. . | |
| 3,797,074 | 3/1974 | Zabiroglu | 19/156.3 |
| 4,442,161 | 4/1984 | Kirayoglu et al. | 28/104 |
| 4,950,264 | 8/1990 | Osborn | 604/387 |
| 5,093,190 | 3/1992 | Kwok et al. | 28/105 |

*Primary Examiner*—James C. Cannon

[57] ABSTRACT

A spun laced fabric consisting essentially of polyester fiber and cellulose fiber selected from the group consisting of cotton and rayon and a process of making said.

6 Claims, 2 Drawing Sheets

HIGH ABSORBENCY CLEANROOM WIPES HAVING LOW PARTICLES

FIELD OF THE INVENTION

This invention relates to cleanroom wipes which when used produce a low number of particles and have high absorbency, and to the process for the manufacture of such wipes. The wipes are manufactured by a spunlaced process i.e. a hydroentangling process.

BACKGROUND OF THE INVENTION:

Cleanroom wipes must produce a low number of particles when they are used, and it is desirable that they have relatively high absorbency rates and capacities. Wipes having all these desired properties have not been available commercially.

Processes for the manufacture of hydroentangled fibrous webs are known in the art: see for example Evans U.S. Pat. No. 3,485,706.

SUMMARY OF THE INVENTION

The present invention is a spunlaced fabric consisting essentially of a mixture of 25 to 65 wt. % of a cellulose fiber selected from the group consisting of cotton and rayon, and 35 to 75 wt. % polyester fiber, said fabric having a particle count no greater than 18 million particles/$m^2$ as measured by the Biaxial Shake (IES-RP-CC-004.2), an Intrinsic Absorbance of at least 5 mL/g, and a Particle Sorbency Quotient (PSQ) of less than 55 million particle/liter sorbed.

The present invention is also a process for the production of an absorbent, low particle-count spunlaced fabric which comprises:

a) passing a web consisting essentially of 25 to 65 wt. % of cellulose fibers selected from cotton and rayon, and 35 to 75 wt. % polyester fibers, supported on one of its two major surfaces by a foraminous screen under a series of water jets that traverse the unsupported major surface of the web, said jets operating at a total impact energy of at least $10\times10^{-3}$ horsepower-hour-pounds force/pounds mass thereby causing the cellulose fibers and the polyester fibers to entangle, and b) passing the web of step a) supported on the second of its two major surfaces by a foraminous surface under a series of water jets the traverse the unsupported major surface of the web, said jets operating at a total impact energy of at least $20\times10^{-3}$ horsepower-hour-pounds force/pound mass, thereby causing further entanglement of the cellulose fibers and the polyester fibers, and the total impact energy of the jets of step (a) plus the jets of step (b) being at least $40\times10^{-3}$ horsepower-hour-pounds force/pound mass.

The process of the invention is preferably operated with the water jets using water at a temperature of at least about 30 degrees C.

BRIEF DESCRIPTION OF THE DRAWINGS

The invention will be better understood with reference to the following figures.

DETAILED DESCRIPTION OF THE INVENTION

Figure 1:
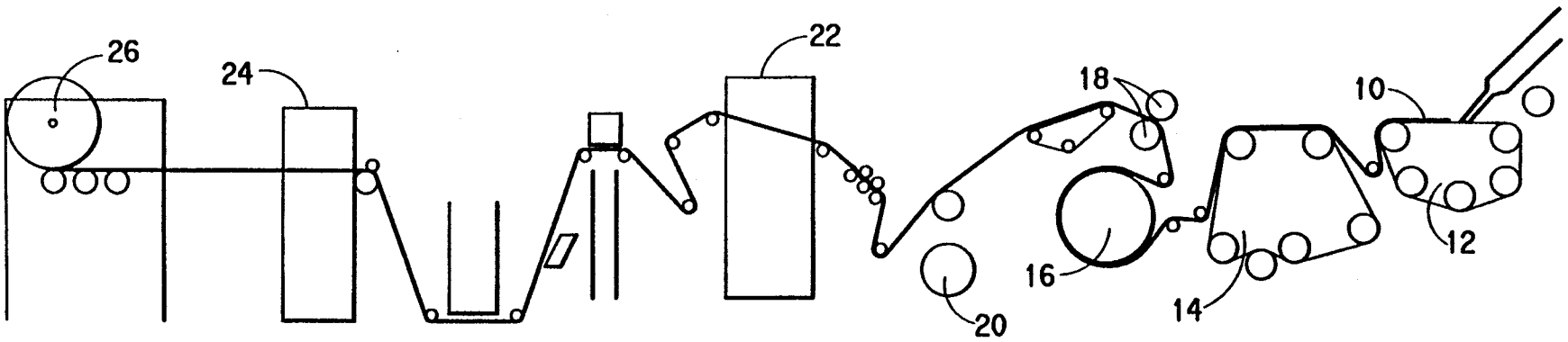
FIG. 1 is a schematic view of a continuous hydroentanglement process of the invention depicting belt and drum washers for water jetting both sides of a fabric web and a conventional squeeze roll for dewatering the resulting fabric following water jetting.

Referring now to the figures, wherein like reference numerals represent like elements, schematic representations are shown of two continuous processes which are used in the invention. FIG. 1 depicts a continuous process wherein a web of fibers 10 (e.g., staple textile fibers of the invention) is air-laid onto a conveyer 12 having a mesh screen and conveyed towards a belt washer 14. The web is air-laid such that the textile staple fibers are supported by the mesh screen. Belt washer 14 contains a series of banks of water jets which treat the fiber web and entangle the textile staple fibers. Thereafter, the hydroentangled web is passed underneath another series of banks of water jets while it is supported on a patterning member of a drum washer 16. This patterning member consists of either 24, 40 or 100 mesh screens. The resulting fabric varies from apertured patterning with the 24 mesh screen to non-apertured non-patterning with the 100 mesh screen. Subsequently, the resulting spunlaced fabric is passed through a pair of squeeze rolls 18 to dewater the fabric. Thereafter, the spunlaced fabric may be further treated by a padder 20, a dryer 22 and a slitter 24 before it is wound up on roll 26.

Figure 2:
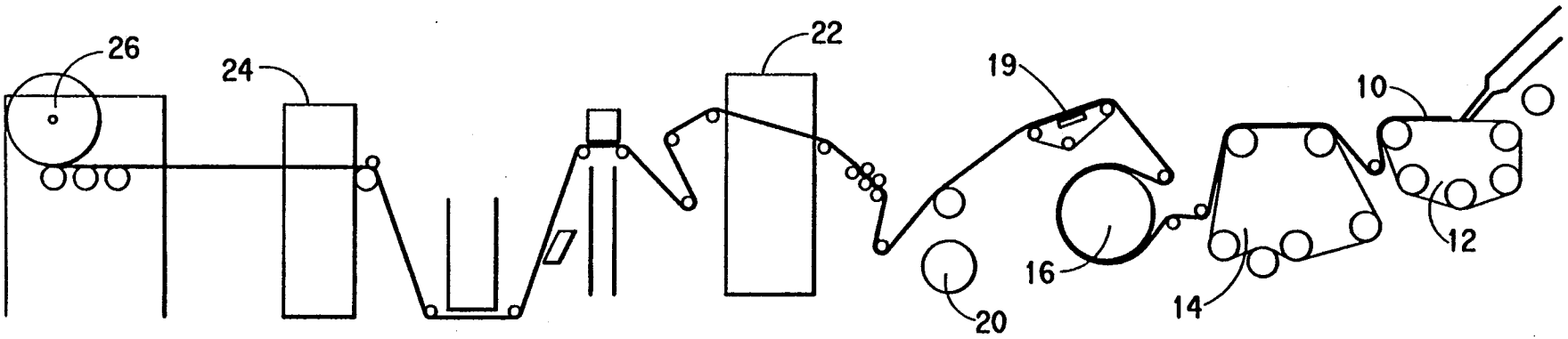

FIG. 2 is identical to FIG. 1, except that the squeeze rolls 18 have been replaced by a vacuum dewatering extractor 19. The vacuum extractor 19 is positioned between the drum washer 16 and the dryer 22.

As indicated above, the web is made up of staple textile fibers of the invention, in particular a mixture of cotton and polyester fibers or rayon and polyester fibers. Such webs may be produced by any conventional dry or wet method. Particularly preferred are the air-laid webs depicted in the figures and produced according to U.S. Pat. No. 3,797,074 (Zafiroglu), the entire contents of which are incorporated by reference herein.

During fabric manufacture, the fibrous web is subjected to jets of water delivered through closely-spaced small orifices. The jets impart to the web a total impact-energy product ("I×E") of at least $40\times10^{-3}$ Horsepower-hour-pounds force/pounds mass (Hp-hr-$lb_f/lb_m$), preferably $60\text{–}80\times10^{-3}$ Hp-hr-$lb_f/lb_m$. Although this follows the general process of U.S. Pat. No. 3,485,706 (Evans), the entire contents of which are incorporated herein by reference, the standard water-jet processing conditions are much less severe with a total I×E of about $20\times10^{-3}$ Hp-hr-$lb_f/lb_m$ or less. In addition, equipment of the general type described above, and mentioned in U.S. Pat. No. 3,485,706 (Evans) and U.S. Pat. No. 3,403,862 (Dworjanyn), is suitable for the water-jet treatment. Further, an increase in jet water temperature appears to be advantageous, i.e., a 8 to 15 degree C increase over the normal room temperature (25 degrees C) water enhances the effect provided by the high impact-energy. The preferred temperature is above about 30 degrees C.

The energy-impact product delivered by the water jets impinging upon the fabric web is calculated from the following expressions, in which all units are listed in the "English" units in which the measurements reported herein were originally made so that the "I×E" ($\times10^{-3}$) product was in horsepower-hour-pounds force per pounds mass.

$$I=2PA'$$

$E = PQ/wzs$ wherein:

I is impact in lbs force

E is jet energy in horsepower-hours per pound mass

P is water supply pressure in pounds per square inch

A' is the apparent cross-sectional area in square inches and is equal to about 0.6 A A is cross-sectional area of the jet in square inches Q is volumetric water flow in cubic inches per minute w is web weight in ounces per square yard z is web width in yards and s is web speed in yards per minute.

The preferred cellulose fiber for use in the invention is rayon, and the most preferred type of rayon is that made by the viscose process.

The preferred fabric contains 30 to 60% rayon, has a particle count of no more than 5 million per square meter, and a PSQ of no greater than 15.

TEST METHODS

The following test procedures were employed to determine the various characteristics and properties reported below:

Wet particle counts were determined by the test methods described in "Evaluating Wiping Materials Used in Cleanrooms and Other Controlled Environments", Institute of Environmental Sciences, IES-RP-CC-004.2 (August, 1992). The wet particle count (i.e., number of particles suspended in water) is measured with a laser counter after the fabric has been washed in water-either under conditions of minimum stress ($P_0$) or after shaking in water for five minutes on a biaxial shaker (BAS). Particle count is recorded as particles/m$^2$ of fabric.

Absorptive capacity, either on a mass or area basis, is measured according to the above-described IES-RP-CC-004.2. Stated briefly, a weighed specimen of wiper is permitted unrestricted time and mechanical stimulus to absorb all of the liquid it can from a pool of water. The wiper is then removed from the pool, and allowed to drain for 60 seconds, and the mass of the absorbed liquid that remains with the wiper is determined. The data is reported in two ways: as an intrinsic absorbency and an extrinsic absorbency. Intrinsic absorbency, $A_i$ [mL/g], is defined as the volume of liquid sorbed per unit mass, while extrinsic absorbency, $A_e$ [mL/m$^2$], is the volume absorbed per unit area of wiper.

Absorption is also characterized by rate of absorption which is determined using a Gravimetric Absorbency Testing System (GATS), available from M/K Systems, Danvers, Mass. In this test, a dry fabric specimen is placed onto a flat surface that is connected by a liquid bridge to a reservoir of water sitting on a top-loading balance. As liquid is taken up by the fabric, the amount transferred from the reservoir to the fabric is recorded as a loss in weight at the balance. The corresponding time interval from test initiation is likewise recorded automatically. The uptake rate is obtained from the rate of change of the balance reading. Typical fabrics absorb liquid most rapidly at the initiation of the test and more slowly as they reach their absorptive limit (absorptive capacity). The rate data reported herein is the rate of liquid uptake when the fabric has reached 50% of its total capacity (Rate @ 50% in g/g/s). Total capacity is reported herein as the weight of liquid sorbed by the fabric, expressed as a percentage based on the sample weight.

Basis weight, [oz/yd$^2$], is determined by measuring the mass of a 4 inch by 6 inch fabric sample according to the method described in INDA Standard Test IST 130.1-92, option 1.2.3, and reported as mass per unit area.

A single expression of two of the most important wiper parameters, absorbency and particles which can be removed, are described by the use of a Particle Sorbency Quotient, PSQ, which quantifies the number of particles introduced into an environment per one liter of water absorbed. Mathematically, $$\begin{aligned} PSQ &= \text{Particles/Liter absorbed} \\ &= (\text{Particles/m}^2)/((\text{mL/m}^2)/(\text{mL/L})) \\ &= BAS/(A_i/1000) \end{aligned}$$

The values are expressed in million particles introduced per liter absorbed.

EXAMPLES

EXAMPLE 1

In this Example, a spunlaced fabric of the invention was made with a mixture of rayon and polyester textile staple fibers in the form of an air-laid web. Commercially available "Dacron" polyester staple fibers (Type 612) from E. I. du Pont de Nemours and Co., Wilmington, Del., having a denier of 1.35 (1.5 dtex) and a length of 0.85 inch (2.16 cm) was combined with synthetic cellulosic staple fiber, a 100% Viscose rayon, code 1641, commercially available from Courtaulds Fibers, Inc., Axis, Ala., having a denier of 1.8 (2.0 dtex) and a length of 1.125 inch (2.86 cm). The mixed staple fibers were air-laid according to the process described in U.S. Pat. No. 3,797,074 (Zafiroglu). Based on the weight of the web, the web had a measured rayon content of about 31% wt. % and a polyester content of about 69 wt. %.

In a continuous operation, the web was supported on a smooth foraminous screen (approximately 76 mesh) such that the bottom side of the web was in contact with the screen. Thereafter, the web was passed along at a belt washer speed of 18 yds/min (16.5 m/min) and then passed underneath a series of banks of belt washer jets under conditions as shown in Table I. The water used for the jets was once-through water that had not been recirculated. In a continuous operation, the web was wrapped around a drum washer over a 40 mesh screen so that the other side of the web (i.e., side contacting the belt washer in that treatment) could be passed underneath a series of banks of drum washer jets under conditions as shown in Table II. Following the drum washer treatment, the spunlaced fabric was dewatered using a vacuum dewatering extractor, dried and wound up. It should be noted that the wind-up speed of the fabric was 20 yds/min (18.3 m/min) and this value was used to calculate the "I×E" product in the Tables below.

TABLE I

| | Belt Washer Treatment | | | | |
|---|---|---|---|---|---|
| Jet No. | Orifice Diameter inch (mm) | # of Jets per inch (cm) | Pressure psi | I × E Hp-hr-lb$_f$/lb$_m$ × $10^{+3}$ | Water Gal/min |
| 1 | 0.005(0.127) | 40(15.7) | 100 | 0.01 | 9 |
| 2 | 0.005(0.127) | 40(15.7) | 500 | 0.34 | 20 |
| 3 | 0.005(0.127) | 40(15.7) | 1000 | 1.90 | 28 |
| 4 | 0.005(0.127) | 40(15.7) | 1500 | 5.23 | 34 |
| 5 | 0.005(0.127) | 40(15.7) | 1915 | 9.63 | 39 |

TABLE I-continued

| Jet No. | Orifice Diameter inch (mm) | Belt Washer Treatment # of Jets per inch (cm) | Pressure psi | I × E Hp-hr-$lb_f/lb_m$ × $10^{+3}$ | Water Gal/min |
|---|---|---|---|---|---|
| 6 | 0.005(0.127) | 40(15.7) | 2000 | 10.73 | 39 |
| Total | | | | 27.84 | 169 |

TABLE II

| Jet No. | Orifice Diameter inch (mm) | Drum Washer Treatment # of Jets per inch (cm) | Pressure psi | I × E Hp-hr-$lb_f/lb_m$ × $10^{+3}$ | Water Gal/min |
|---|---|---|---|---|---|
| 1 | 0.005(0.127) | 60(23.6) | 450 | 0.39 | 28 |
| 2 | 0.005(0.127) | 40(15.7) | 800 | 1.09 | 25 |
| 3 | 0.005(0.127) | 60(23.6) | 1200 | 4.49 | 46 |
| 4 | 0.005(0.127) | 60(23.6) | 1500 | 7.84 | 51 |
| 5 | 0.005(0.127) | 60(23.6) | 1915 | 14.44 | 48 |
| 6 | 0.005(0.127) | 60(23.6) | 2000 | 16.10 | 59 |
| Total | | | | 44.35 | 257 |

The fabric was tested for absorption and wet particle release and generation under conditions of minimum stress or after shaking for five minutes on a biaxial shaker as discussed above. The results are tabulated below in Table III and can be compared to results for standard spunlaced product and several competitive wipe fabrics which are found in Table IV. The substantial reduction in particle generation is attributed to the effect of the higher-than-normal impact-energy and the somewhat elevated jet-water temperature which is thought to physically remove and at least partially dissolve the removed particles. The inventive fabric has much lower particle generation compared to standard spunlaced rayon/polyester products, Comparative Examples A and B, or other competitive wiper products of rayon or cotton, Comparative Examples D and E. In fact, the inventive fabric is quite comparable to a the TEXWIPE TX1010 knit polyester, Comparative Example C, a high quality cleanroom wipe, in terms of low particle generation but much superior in absorption.

Examples 2 to 7 were prepared similarly to Example 1 with any changes, e.g. I×E, water-jet temperature, fiber content, noted in Tables III and V along with the results of testing for absorption and particle generation. Example 2 was run at conditions not much different from Example 1 with equally good results. Example 3, although prepared at a I×E of $45\times10^{-3}$ compared to about an I×E value about $72\times10^{-3}$ for Examples 1 and 2 and possessing a higher rayon content, is still much improved over the standard spunlaced product, Comparative Examples A and B, and the competitive products, Comparative Examples C, D, and E.

Examples 4 to 7 compares rayon to cotton (pre-opened, bleached, and scoured cotton staple of approximately 1 inch (2.54 cm), coded 563004, obtained from Veratec, Inc., Walpole, Me., a division of International Paper) at 50 wt. % cellulosic to polyester content and shows there is essentially no effect on particle generation when varying the mesh of the drum screen from 24 which gives an apertured, patterned product to 100 mesh which gives a non-apertured, non-patterned product. Although not improved to the same extent as the rayon, the cotton/polyester product of the invention is substantially improved over the competitive cotton product generating much, much lower number of particles generated in testing.

TABLE III

| | Example 1 | 2 | 3 |
|---|---|---|---|
| Composition | 31% rayon | 37% rayon | 60% rayon |
| Water Temperature, °C. | 33 | 40 | 25 |
| Drum Mesh | 40 | 40 | 40 |
| I × E (Belt) × $10^{+3}$ | 27.8 | 27.6 | 22.5 |
| I × E (Drum) × $10^{+3}$ | 44.3 | 44.1 | 22.5 |
| I × E - Total × $10^{+3}$ | 72.1 | 71.7 | 45.0 |
| Dewatering | Vacuum | Vacuum | Squeeze |
| Intrinsic Absorbance, $A_i$, mL/g | 6.1 | 5.8 | 6.4 |
| Extrinsic Absorbance, $A_e$, mL/$m^2$ | 412 | 369 | 427 |
| Absorbent Capacity, % | 621 | 587 | 490 |
| Absorbent Rate, @50% Capacity g/g/s | 0.20 | 0.13 | 0.27 |
| Basic Weight, oz/$yd^2$ | 2.01 | 1.91 | 2.21 |
| Particle Count, $P_0$, $10^6/m^2$ | 1.5 | 2.1 | 7.9 |
| Particle Count, BAS, $10^6/m^2$ | 0.5 | 1.7 | 4.3 |
| PSQ, $10^6$ particles/L | 1.2 | 4.7 | 10.1 |

TABLE IV

| | COMPARATIVE EXAMPLES STANDARD SPUNLACED A SONTARA STYLE 8423 | B SONTARA STYLE 8425 | COMPETITIVE EXAMPLE C TEXWIPE TX1010 | D BEMCOT CT-8 | E BERKSHIRE SPECWIPE-1 |
|---|---|---|---|---|---|
| Composition | 70% rayon | 50% rayon | 100% polyester knit | 100% rayon | 100% cotton |
| Basis Weight oz/$yd^2$ | 2.3 | 1.8 | 4.2 | 0.92 | 4.3 |
| $A_i$, mL/g | 6.63 | 6.9 | 2.0 | 9.0 | 1.62 |
| $A_e$, mL/$m^2$ | 508 | 417 | 226 | 280 | 271 |
| I × E - Total × $10^{+3}$ | 21.1 | 26.1 | NA | NA | NA |
| Particle Count, $P_0$, $10^6/m^2$ | 3.3 | 81 | 2.3 | 33 | 34 |
| Particle Count, BAS, $10^6/m^2$ | 32 | 18 | 4.1 | 193 | 301 |
| PSQ, ($10^6$ part)/L | 63 | 43 | 18 | 689 | 1111 |

TABLE V

| | Example 4 | 5 | 6 | 7 |
|---|---|---|---|---|
| Composition | 50% cotton | 50% cotton | 50% rayon | 50% rayon |
| Water Temperature, degrees C. | 25 | 25 | 25 | 25 |
| Drum Mesh | 24 | 100 | 100 | 24 |
| I × E (Belt) × $10^{+3}$ | 20 | 20 | 20 | 20 |
| I × E (Drum) × $10^{+3}$ | 20 | 20 | 20 | 20 |
| I × E - Total × $10^{+3}$ | 40 | 40 | 40 | 40 |
| Dewatering | Squeeze | Squeeze | Squeeze | Squeeze |
| Intrinsic Absorbance, $A_i$, mL/g | 5.8 | 5.5 | 6.0 | 6.4 |
| Extrinsic Absorbance, $A_e$, mL/$m^2$ | 342 | 321 | 369 | 393 |
| Absorbent Capacity, % | 501 | 517 | 523 | 513 |
| Absorbent Rate, @50% Absorption g/g/s | 0.23 | 0.23 | 0.22 | 0.20 |
| Basis Weight, oz/$yd^2$ | 1.75 | 1.80 | 1.77 | 1.76 |
| Particle Count, $P_o$, $10^6/m^2$ | 5.4 | 7.0 | 8.6 | 14 |

TABLE V-continued

| | Example | | | |
|---|---|---|---|---|
| | 4 | 5 | 6 | 7 |
| Particle Count, BAS, $10^6/m^2$ | 11.7 | 14.4 | 3.0 | 4.2 |
| PSQ, $10^6$ particles/L | 34 | 45 | 8 | 11 |

I claim:

1. A spunlaced fabric consisting essentially of a mixture of 25 to 65 wt. % of a cellulose fiber selected from the group consisting of cotton and rayon, and 35 to 75 wt. % polyester fiber, said fabric having a particle count no greater than 18 million particles/$m^2$ as measured by the Biaxial Shake (IES-RP-CC-004.2), an Intrinsic Absorbance of at least 5, and a Particle Sorbency Quotient of less than 55.

2. The spunlaced fabric of claim 1 in which the cellulose fiber is rayon made by the viscose process.

3. The spunlaced fabric of claim 1 in which the cellulose fiber is rayon, the rayon is present in the amount of between 30 and 60%, the fabric having a particle count no more than 5 million/$m^2$ and a Particle Sorbency Quotient of no greater than 15.

4. The spunlaced fabric of claim 3 in which the rayon is made by the viscose process.

5. A process for the production of an absorbent, low particle-count spunlaced fabric which comprises:

a) passing a web consisting essentially of 25 to 65 wt. % of cellulose fibers selected from cotton and rayon, and 35 to 75 wt. % polyester fibers, supported on one of its two major surfaces by a foraminous screen under a series of water jets that traverse the unsupported major surface of the web, said jets operating at a total impact energy of at least $10\times10^{-3}$ horsepower-hour-pounds force/pounds mass thereby causing the cellulose fibers and the polyester fibers to entangle, and b) passing the web of step a) supported on the second of its two major surfaces by a foraminous surface under a series of water jets that traverse the unsupported major surface of the web, said jets operating at a total impact energy of at least $20\times10^{-3}$ horsepower-hour-pounds force/pound mass, thereby causing further entanglement of the cellulose fibers and the polyester fibers, and the total impact energy of the jets of step (a) plus the jets of step (b) being at least $44\times10^{-3}$ horsepower-hour-pounds force/pound mass.

6. The process of claim 5 in which the water temperature is at least about 30 degrees C.

* * * * *